US005198321A

United States Patent [19]

Hosoi et al.

[11] Patent Number: 5,198,321

[45] Date of Patent: Mar. 30, 1993

[54] IMAGE FORMING METHOD

[75] Inventors: Noriyuki Hosoi; Kotaro Nakamura, both of Shizuoka, Japan

[73] Assignee: Fuji Photo Film Co., Ltd., Kanagawa, Japan

[21] Appl. No.: 770,212

[22] Filed: Oct. 3, 1991

[30] Foreign Application Priority Data

Oct. 3, 1990 [JP] Japan ..... 2-265551

[51] Int. Cl.[5] ..... G03C 1/72; G03C 5/56

[52] U.S. Cl. ..... 430/138; 430/200; 430/201; 430/256; 430/332; 430/346; 430/348; 430/363; 430/944; 430/945; 430/964; 503/201

[58] Field of Search ..... 430/964, 332, 346, 348, 430/363, 138, 945, 944, 200, 201, 256, 259, 262, 263; 503/201

[56] References Cited

U.S. PATENT DOCUMENTS 4,585,722 4/1986 Morinaka et al. ..... 430/201
4,588,674 5/1986 Stewart et al. ..... 430/346
4,720,449 1/1988 Borror et al. ..... 430/945
4,857,501 8/1989 Usami et al. ..... 503/200
4,956,251 9/1990 Washizu et al. ..... 430/138

FOREIGN PATENT DOCUMENTS 3-043294 2/1991 Japan ..... 430/363

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A method for forming an image is described which includes bringing a transparent heat-sensitive recording material including a transparent support made of a synthetic polymer having thereon a transparent heat-sensitive recording layer into contact with a light-absorbing material, at least at the time of effecting recording, and irradiating the light-absorbing material with a laser beam to heat the transparent heat-sensitive recording layer and to cause color formation therein. High speed, high density, and high quality recording can be performed with an increased light absorption efficiency.

10 Claims, No Drawings

IMAGE FORMING METHOD

FIELD OF THE INVENTION

This invention relates to an image forming method using a laser beam, and more particularly to an image forming method with a non-contact heat-sensitive recording system using a laser beam as a heat energy source.

BACKGROUND OF THE INVENTION

A heat-sensitive recording system using a heat-sensitive recording material comprising a support having thereon a heat-sensitive recording layer is well known and widely applied to facsimiles and printers, in which a thermal head passes over the recording material in contact therewith to transfer heat energy to the heat-sensitive recording layer either directly or via a protective layer, thereby recording a colored image. In such a heat-sensitive recording system, since the thermal head is in contact with the heat-sensitive recording material and passes thereover, it becomes abraded and worn, or the constituents of the heat-sensitive recording material adhere to the surface of the thermal head, which often results in the failure of the thermal head to reproduce an accurate image or leads to the destruction of the head.

Further, as a result of the structural characteristics of the thermal head, there are limits on the high speed control of the heating and cooling of the heating element and on the density of the heating element, which have made it difficult to achieve high performance recording features such as high speed recording and high density and high quality recording.

In order to overcome these problems associated with heat-sensitive recording systems using a thermal head, the use of a laser beam as an energy source to conduct thermal recording without placing a thermal head in contact with a heat-sensitive recording material and to achieve high speed and high density recording has been disclosed, e.g., in WO 884237A, JP-A-50-23617, JP-A-54-121140, JP-A-57-11090, JP-A-58-56890, JP-A-58-94494, JP-A-58-134791, JP-A-58-145493, JP-A-59-89192, JP-A-60-205182, and JP-A-62-56195 (the term "JP-A" as used herein means an unexamined published Japanese patent application). With such a laser beam recording system, though, a considerably high laser output is required for obtaining the heat energy necessary for coloration, because a heat-sensitive recording layer, in general, hardly adsorbs light in the visible and near infrared regions. Therefore, it is very difficult to make a small-sized and inexpensive recording device containing a laser.

In this regard, many techniques have been proposed to provide efficient absorption of laser light into a heat-sensitive recording layer. A commonly applied technique is to add a substance capable of absorbing light of the same wavelength as a laser beam to the heat-sensitive recording layer. In this case, the light absorbing substance to be added must be white. Otherwise, the recording material will provide a recorded image of low quality due to low contrast. In general, many white light-absorbing substances are inorganic compounds, and most of the inorganic light absorbing substances have a low light-absorbing efficiency. No organic compound having a satisfactory light-absorbing efficiency while being free from coloration has been developed yet.

SUMMARY OF THE INVENTION

An object of the present invention is to provide a method for forming an image which uses a transparent heat-sensitive recording material to obtain a recorded image exhibiting satisfactory reproducibility of broad gradation and high contrast, which uses a laser beam to provide heat energy to accomplish high speed and high accuracy recording without the need for a thermal head to make contact with the heat-sensitive recording material, and which makes it feasible to reduce the size and cost of a recording device.

The present invention relates to a method for forming an image which comprises bringing a transparent heat-sensitive recording material comprising a transparent support made of a synthetic polymer having thereon a transparent heat-sensitive recording layer into contact with a light-absorbing material, at least at the time of effecting recording, and irradiating the light-absorbing material with a laser beam to heat the transparent heat-sensitive recording layer and to cause color formation therein. The present invention provides a method to form a recorded image in the heat-sensitive recording layer in conformity with the amount of irradiation.

It is preferable that the laser beam should irradiate the light-absorbing material through the support and the heat-sensitive recording layer of the heat-sensitive recording material.

DETAILED DESCRIPTION OF THE INVENTION

The light-absorbing material which can be used in the present invention preferably comprises a synthetic polymer or rubber having a light-absorbing substance incorporated therein. A synthetic polymer or rubber material on which a light absorbing substance is coated can also be employed.

The light-absorbing material may be in the form of roll, sheet or block. In order to achieve ease of recording and high speed recording, the light-absorbing material preferably has a roll form. The thickness of the light-absorbing material is more than 5 μm.

Light-absorbing substances which can be used in the layer containing the light-absorbing material are substances capable of absorbing light from a laser beam and include, for example, copper sulfate as disclosed in JP-A-58-94495; cyanine dyes as disclosed in JP-A-58-94494; benzenedithiol-type nickel complexes as disclosed in JP-A-57-11090; benzenethiol nickel complexes as disclosed in JP-A-54-121140; inorganic metal salts as disclosed in JP-A-58-145493; and conventionally known light-absorbing substances, such as oxides, hydroxides, silicates, sulfates, carbonates, nitrates, complexes of metals, cyanines, and polyenes. However, these compounds have an extremely low light-absorbing efficiency so an increased laser output is required. In addition, they are not particularly suitable for use with semiconductor lasers, which are not only easy to handle but are also the most promising for achieving reductions in cost and size in the future. Thus, while these compounds can be used in the present invention, the most suitable light-absorbing substance for use in the present invention is carbon black. In particular, carbon black having an average particle size of from about 0.1 to 100 μm is preferred.

Examples of synthetic polymers are polyester, polyethylene, polypropylene, polystyrene, polycarbonate, acrylic resin, phenolic resin, melamine resin. Examples of rubbers are natural rubber, acrylic rubber, Neophene rubber and styrene-butadiene rubber.

The light-absorbing material can be prepared by mixing the light-absorbing substance with a synthetic polymer or rubber using a homogenizer or a roller mill and then molding the mixture.

Alternatively, it can be prepared by dissolving or dispersing the light-absorbing substance in a organic solvent or water and coating the resulting solution or dispersion on the surface of a synthetic polymer or rubber.

The content of the light-absorbing substance in a synthetic polymer or rubber material is 1 to 20% by weight, preferably 5 to 10% by weight.

The light-absorbing material according to the present invention broadly includes recorded images formed of a substance which can absorb a laser beam, such as originals written with general black pencils, originals written with black felt pens or markers, electrophotographic images, recorded images formed by a heat transfer printing system, and the like.

The transparent support to be used in the heat-sensitive recording material of the present invention includes a film of transparent synthetic polymers such as polyesters (e.g., polyethylene terephthalate, polybutylene terephthalate), cellulose derivatives (e.g., cellulose triacetate), polyolefins (e.g., polystyrene, polypropylene, polyethylene), polyimide, polyvinyl chloride, polyvinylidene chloride, polyacrylate, and polycarbonate. These polymer films may be used either individually or in the form of a laminate of two or more thereof. It is desirable that the synthetic polymer support has high transparency, shows no absorption at wavelengths of the irradiated laser beam, and has dimensional stability against the heat generated by laser irradiation. The support usually has a thickness of from about 10 to 200 μm.

The transparent heat-sensitive recording materials which can be used in the present invention include those having a heat-sensitive recording layer containing an achromatic electron-donating dye precursor (called a coupler) and an electron-accepting compound (called a developer) which are brought into contact and reacted with each other to form a color upon heating, the heat-sensitive recording layer being designed so as to have substantial transparency. Details of the electron-donating dye precursors, electron-accepting compounds, and various additives to be used in the recording layer of this type are described, e.g., in U.S. Pat. No. 4,857,501 and JP-A-62-64592. The transparent heat-sensitive recording materials for the present invention also, include recording materials utilizing a reaction between a diazonium salt and a coupler to form an azo dye, which are designed so as to have a substantially transparent heat-sensitive recording layer. Examples of the diazonium salts, couplers, bases, and the like to be used in this type of recording material are described, e.g., in U.S. Pat. No. 4,665,411, GB-A-123224 and JP-A-59-190886.

The transparent heat-sensitive recording materials of the first type set forth above can be prepared, for example, as follows.

A dispersion of microcapsules containing an achromatic electron-donating dye precursor described in U.S. Pat. No. 4,857,501 and JP-A-62-64592 as a coupler is mixed with an emulsion of an electron-accepting compound described in JP-A-62-64592 as a developer, which is prepared by dissolving the electron-accepting compound in a sparingly water-soluble or water-insoluble organic solvent, and emulsifying and dispersing the solution. The composition thus obtained is coated on a support and dried.

The electron-donating dye precursor is a colorless compound selected from known compounds capable of donating an electron or accepting a proton, e.g., an acid, to develop a color. Such an achromatic electron-donating dye precursor is a compound having the structure of lactones, lactams, sultones, spiropyrans, esters, amides, etc., as a partial skeleton which is opened or cleaved on contact with a developer. Examples of preferred achromatic electron-donating dye precursors include triarylmethane compounds, diphenylmethane compounds, xanthene compounds, thiazine compounds, and spiropyran compounds.

Examples of the electron-accepting compounds are acidic substances such as phenol derivatives, organic acids or metal salts thereof and hydroxybenzoic acid ester, which are specifically disclosed in, for example, JP-A-61-291183.

The second type transparent heat-sensitive recording materials can be prepared in the same manner as the first type materials. Thus, a dispersion of microcapsules containing a diazonium salt is mixed with an emulsion of a coupler and a base which is prepared by dissolving a coupler and a base in a sparingly water-soluble or water-insoluble organic solvent followed by emulsification and dispersion. The coating composition thus obtained is coated on a support and dried.

The coupler is encapsulated so as to prevent the generation of fog during preparation of the heat-sensitive recording material and to assure preservability of the heat-sensitive recording material and the recorded image. The coupler is preferably used in an amount of from about 0.05 to 5.0 $g/m^2$ in the recording material.

Microcapsules of the coupler are prepared by emulsifying a core material containing a coupler to form oil droplets and then forming a wall of a polymer around the oil droplets. The polymer capsule wall is formed by adding at least one polymer-forming reactant to the inside or outside of the oil droplets.

Specific examples of the polymers include polyurethane, polyurea, polyamide, polyester, polycarbonate, urea-formaldehyde resins, melamine resins, polystyrene, styrene-methacrylate copolymers, styrene-acrylate copolymers, gelatin, polyvinyl pyrrolidone, and polyvinyl alcohol. These polymers may be used either individually or in combination of two or more thereof. Of these polymers, polyurethane, polyurea, polyamide, polyester, and polycarbonate are preferred with polyurethane and polyurea being particularly preferred.

The microcapsule wall of the present invention is preferably prepared in accordance with the microcapsulation method utilizing polymerization of reactants from the inside of the oil droplets. According to this method, microcapsules which are preferably used for a recording material having uniform particle size and having good shelf life stability before recording can be prepared in a short time.

The above method and specific examples of the compounds are described in U.S. Pat. Nos. 3,726,804 and 3,796,696, and JP-A-59-222716.

For example, in the case of using polyurea as the capsule wall material, microcapsule walls may be prepared by mixing a polyvalent isocyante with an oily liquid to be made into capsules, then emulsifying and dispersing the resulting mixture in water or a polyamine aquerous solution and then raising the temperature of the emulsified dispersant to generate polymer formation reaction at the interface of oil drops. In this instance, an auxiliary solvent having a low boiling point and a high solubility may be added to the oily liquid. Examples of polyisocyanates and polyamines to be reacted therewith are disclosed in U.S. Pat. Nos. 3,281,383, 3,773,695, and 3,793,268, JP-B-48-40347, JP-B-49-24159, JP-A-48-80191 and JP-A-48-84086.

The polyurethane wall can be formed by reacting polyol with isocyanate.

Examples of isocyanate includes diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-diphenyl diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, or cyclohexylene-1,4-diisocyanate; triisocyanate such as 4,4',4''-triphenylmethanetriisocyanate, or toluene-2,4,6-triisocyanate; tetraisocyanates such as 4,4'-dimethyldiphenylmethane-2,2',5,5'-tetraisocyanate; and isocyanate prepolymer such as an adduct product of hexamethylene diisocyanate and trimethylolpropane, and an adduct product of 2,4-tolylene diisocyanate and trimethylolpropane, and an adduct product of xylylene diisocyanate and trimethylolpropane, and an adduct product of tolylene diisocyanate and hexanetriol.

Water soluble polymers may be useful for the preparation of microcapsules. In this instance, any of anionic, nonionic and amphoteric water soluble polymers may be effective. As water soluble anionic polymers, both natural and synthetic polymers may be useful which for example have a $—COO^-$ group, a $—SO_2^-$ group and the like. Specific examples of water soluble anionic polymers include: natural polymers such as gum arabic, alginic acid and the like; semi-synthetic polymers such as carboxymethyl cellulose, phthalate gelatin, sulfated starch, sulfated cellulose, lignin sulfonate and the like; and synthetic polymers such as copolymers of maleic anhydride (including hydrolyzed products), polymers and copolymers of acrylic acid (including methacrylic acid), polymers and copolymers of vinylbenzenesulfonate, carboxy-modified polyvinyl alcohol and the like. As water soluble nonionic polymers, polyvinyl alcohol, hydroxyethyl cellulose, methyl cellulose and the like may be useful. Gelatin and the like may be effective as water soluble amphoteric polymers. These water soluble polymers may be used as an aqueous solution of 0.01 to 10 w/w %.

The size of capsules suitable for use in the present invention may be 20 μm or smaller.

Organic solvents which can be used for incorporating a coupler and the like into microcapsules and dissolving the monomers to carry out encapsulation, for dissolving and emulsifying a developer to prepare a developer dispersion, or for forming oil droplets are appropriately selected according to the properties of the substance to be dissolved. Examples of suitable organic solvents include ester compounds, such as phosphoric esters, phthalic esters, benzoic esters, adipic esters, oxalic esters, acetic esters, and carbonic esters; naphthalene compounds, such as dimethylnaphthalene, diethylnaphthalene, and diisopropylnaphthalene; biphenyl compounds, such as dimethylbiphenyl, diethylbiphenyl, diisopropylbiphenyl, and diisobutylbiphenyl compounds; phenylmethane compounds, such as 1-methyl-1-dimethylphenyl-1-phenylmethane, 1-ethyl-1-dimethylphenyl-1-phenylmethane, and 1-propyl-1-dimethylphenyl-1-phenylmethane; triallylmethane compounds, such as tritoluylmethane and toluyldiphenylmethane; diphenyl ether compounds, such as propyldiphenyl ether and terphenyl compounds. These organic solvents may be used either alone or in combination with other organic solvents.

If desired, low boiling point solvents, e.g., ethyl acetate, isopropyl acetate, butyl acetate, methylene chloride, and chloroform, may be used as auxiliary solvents in addition to the above-mentioned organic solvents.

The developer dispersion can easily be obtained by mixing and dispersing an oil phase containing a developer and an aqueous phase containing a protective colloid and a surfactant by use of means generally employed for fine grain emulsification, such as high-speed agitation and ultrasonic dispersion.

Anionic or nonionic surfactants selected from those which do not react with the above-mentioned protective colloid to cause precipitation or coagulation can be used in the aqueous phase. Examples of suitable surfactants are sodium alkylbenzenesulfonates, e.g., sodium dodecylbenzenesulfonate; sodium alkylsulfates, e.g., sodium lauryl sulfate; sodium dioctyl sulfosuccinate, and polyoxyethylene nonylphenyl ether.

The coating composition can include a binder set forth below. Binders which can be used include emulsions of polyvinyl alcohol, methyl cellulose, carboxymethyl cellulose, hydroxypropyl cellulose, gum arabic, gelatin, polyvinyl pyrrolidone, casein, a styrene-butadiene latex, an acrylonitrile-butadiene latex, polyvinyl acetate, polyacrylic esters, and an ethylene-vinyl acetate copolymer. The binder is used in an amount of from about 0.5 to 5 $g/m^2$ on a solid basis.

The recording material according to the present invention can be produced by coating a coating composition comprising the coupler-containing microcapsule and developer dispersion as main components, a binder, and other necessary additives on a transparent synthetic polymer support by bar coating, blade coating, air knife coating, gravure coating, roll coating, spray coating, dip coating, curtain coating, or a like coating technique, followed by drying to form a heat-sensitive recording layer having a solids content of from about 2.5 to 25 $g/m^2$.

The laser beam which is employed in the present invention include a laser beam having a wavelength region in the visible, near infrared, or infrared region, such as a helium-neon laser, an argon laser, a carbon dioxide gas laser, a YAG laser, and a semiconductor laser.

It is necessary that the light-absorbing material and the heat-sensitive recording material should be in contact at the time of irradiation with a laser beam so that the heat energy generated in the light-absorbing material by the laser beam irradiation may be transferred to the heat-sensitive recording material without a loss. It is preferable that the surfaces of these materials be sufficiently smooth and that the heat-sensitive recording material and the light-absorbing material be brought into contact under a load while being irradiated with a laser beam.

In carrying out the method of the present invention, the transparent heat-sensitive recording layer provided on a transparent synthetic polymer support is brought into contact with the light-absorbing material containing a light-absorbing substance, e.g., carbon black, and the light-absorbing material is irradiated with a laser beam through the synthetic polymer support and the heat-sensitive recording layer, whereby the light absorbing material generates heat, and the heat is transferred to the heat-sensitive recording layer in contact with the light-absorbing material to induce a coloration reaction for image recording. After irradiation, the light-absorbing material and the heat-sensitive recording material are separated from each other.

According to the image forming method of the present invention, the problems associated with the conventional heat-sensitive recording system using a thermal head which is placed in contact with the recording material and is scanned thereover, i.e., abrasion of the thermal head, adhesion of constituents to the thermal head, destruction of the thermal head, difficulty in achieving high speed and high quality recording, can be overcome.

The present invention is now illustrated in greater detail with reference to the following examples, but it should be understood that the present invention is not deemed to be limited thereto.

EXAMPLE 1

A transparent heat-sensitive recording material was prepared as follows.

Preparation of microcapsule suspension:

In a solvent mixture of 55 g of 1-phenyl-2-xylylethane and 55 g of methylene chloride were dissolved 14 g of Crystal Violet lactone (leuco dye), 60 g of Takeneito D-110N (capsule wall material, manufactured by Takeda Chemical Indus tries Ltd.) and 2 g of Sumisorb 200 (ultraviolet ray absorbing agent manufactured by Sumitomo Chemical Co., Ltd.). The leuco dye solution thus prepared was mixed with a solution containing 100 g of 8% aqueous solution of polyvinyl alcohol, 40 g of water and 1.4 g of 2% aqueous solution of sodium dioctyl sulfosuccinate (dispersing agent), and the resulting mixture was emulsified using ACE HOMOGENIZER (manufactured by Nihon Seiki Kaisha Ltd.) at 10,000 rpm for 5 minutes. Thereafter, the emulsion was mixed with 150 g of water and allowed to react at 40° C. for 3 hours to obtain a capsule suspension with mean capsule size of 0.7 μm.

Preparation of emulsion of developer:

In a solvent mixture of 2.0 g of 1-phenyl-1-xylylethane, 6.0 g of dibutyl phthalate and 30 g of ethyl acetate were dissolved 8 g of developer (a), 4 g of developer (b) and 30 g of developer (c) represented by the following formulae. The thus-obtained developer solution was added to a mixture of 100 g of 8% polyvinyl alcohol aqueous solution, 150 g of water and 0.5 g of aqueous solution of sodium dodecylbenzenesulfonate. Thereafter, the resulting mixture was subjected to emulsification using ACE HOMOGENIZER (manufactured by Nihon Seiki Kaisha Ltd.) at 10,000 rpm for 5 minutes to obtain an emulsion with a particle diameter of 0.5 μm.

Developer (a)
Zinc salt of

-continued

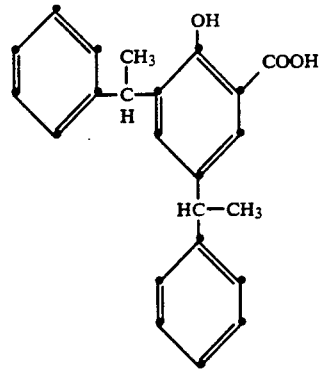

Developer (b)

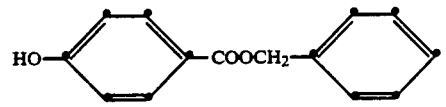

Developer (c)

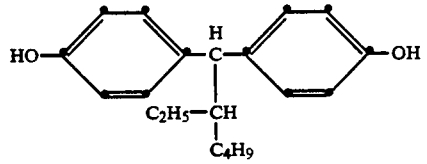

5.0 g of the microcapsule suspension, 10.0 g of the developer emulsion and 5.0 g of water were mixed and then, the resulting coating composition was coated on the surface of a transparent polyethylene terephthalate (PET) film having a thickness of 70 μm in such an amount that the solid contents on the film became 15 g/m$^2$. After drying, the surface of the thus obtained heat-sensitive layer was further coated with 2 μm of a protection layer having the following composition:

| | |
|---|---|
| 10% polyvinyl alcohol | 20 g |
| water | 30 g |
| 2% aqueous solution of sodium dioctyl sulfosuccinate | 0.3 g |
| dispersion prepared by dispersing 3 g of polyvinyl alcohol, 100 g of water and 35 g of kaolin with a ball mill | 3 g |
| Hydrin Z-7 (manufactured by Chukyo Yushi Co., Ltd.) | 0.5 g |

A polystyrene resin roll containing 10% by weight of carbon black and a heat-sensitive recording layer of the transparent heat-sensitive recording material obtained as described above were brought into contact, and a semiconductor laser beam (GaAs conjucative laser) was irradiated thereover to obtain a colored image. The output of the laser was so adjusted as to provide heat energy of 40 mJ/mm$^2$ per millisecond to the surface of the heat-sensitive recording layer.

The transmission density of the colored area was found to be 1.05, as measured with a Macbeth densitometer.

When the same test was carried out, except that no light-absorbing substance was used, the density of the colored image was 0.21, that is, no appreciable color formation took place.

EXAMPLE 2

The term "parts" as used below indicates an addition amount based on weight.

10 parts of the following light-absorbing compound,

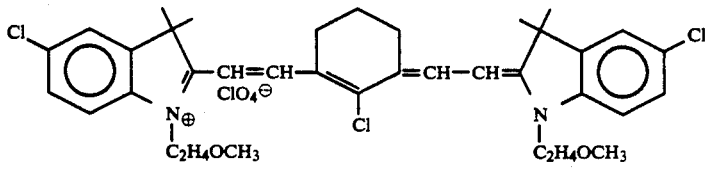

and 90 parts of polystyrene resin were dissolved in 100 parts of toluene. The resulting mixture was coated on polyethylene terephthalate film in such an amount that the dry contents on the film became 10 g/m: and the coated solution was dried. Then, thus-obtained light-absorbing material and the transparent heat-sensitive recording material prepared in the same manner as Example 1 were brought into contact and a colored image was recorded in the same manner as in Example 1.

The transmission density of the colored area was found to be 0.93 as measured with Macbeth densitometer.

COMPARATIVE EXAMPLE 1

20 g of 3-diethylamino-6-chloro-7-(β-ethoxyethylamino)-fluoran was dispersed in 100 g of 5% aqueous solution of polyvinyl alcohol (degree of polymerization: 1000, saponification value: 90) using a ball mill for 24 hours. The resulting solution is referred to as A solution.

60 g of bisphenol A and 60 g of stearic acid amide were dispersed in 900 g of 5% aqueous solution of polyvinyl alcohol (degree of polymerization: 1000, saponification value: 90) using a ball mill for 24 hours. The resulting solution is referred to as B solution.

The coating composition was prepared by mixing A solution with B solution, adding to the mixture to 1200 g of calcium carbonate (Univar: tradename of the product manufactured by Shiraishi Kogyo) and 6000 g of 5% aqueous-solution of polyvinyl alcohol and dispersing it thoroughly.

100 parts of LBKP was heat-treated at 350 cc of Canadian standard freeness, 1 part of rosin and 2 parts of sulfonic acid band were added thereto and a base paper having a basis weight of about 50 g/m$^2$ was prepared using Fourdrinier wire paper machine. The surface of a wire side of a wet base paper which had passed through the press section was brought into contact on a Yankee dryer having a surface temperature of 120° C. The base paper was dried to a moisture content of 8% and was subjected to machine calender treatment.

The coating solution as prepared above was coated on the thus-obtained base paper by air knife coating, so that the coating amount (solid content) was 7 g/m$^2$. After drying to a moisture content of 6%, the base paper was passed through a pressure machine having a hard chromium plating roll and a hard rubber roll (Shore hardness: 80). Thus, a heat-sensitive recording material was obtained.

The light-absorbing material as prepared in Example 1 and the recording layer of the heat-sensitive recording material as prepared above were brought into contact and a colored image was recorded in the same manner as in Example 1. As a result, coloration was scarcely observed.

COMPARATIVE EXAMPLE 2

A' solution was prepared by dispersing 35 parts of Crystal Violet lactone, 150 parts of 10% aqueous solution of polyvinyl alcohol and 65 parts of water in a ball mill.

B' solution was prepared by dispersing 35 parts of bisphenol A, 150 parts of 10% aqueous solution of polyvinyl alcohol and 65 parts of water in a ball mill.

C solution was prepared by dispersing 35 parts of bis(1-thio-2-phenolate)nickel-tetrabutyl ammonium (infrared-absorbing dye), 150 parts of 10% aqueous solution of polyvinyl alcohol and 65 parts of water in a ball mill.

5 parts of A' solution, 67 parts of B, solution and 50 parts of C solution were mixed together to obtain a coating composition. The coating composition was coated on the surface of fine paper to obtain a heat-sensitive recording paper having a solid contents of 1 5 g/m$^2$. The thus-obtained recording paper was irradiated with a laser beam. As a result, the recording material was unfavorably colored in blue green though a colored image was formed.

While the invention has been described in detail and with reference to specific examples thereof, it will be apparent to one skilled in the art that various changes and modifications can be made therein without departing from the spirit and scope thereof.

What is claimed is:

1. A method for forming an image which comprises bringing a transparent heat-sensitive recording material comprising a transparent support made of a synthetic polymer having thereon a transparent heat-sensitive recording layer into contact with a light-absorbing material, at least at the time of effecting recording, irradiating said light-absorbing material with a laser beam to heat said transparent heat-sensitive recording layer and to cause color formation therein, and separating the light-absorbing material and the heat-sensitive recording material from each other after irradiation.

2. A method for forming an image as in claim 1, wherein said laser beam irradiates said light-absorbing material through said support and said heat-sensitive recording layer of said heat-sensitive recording material.

3. A method for forming an image as in claim 1, wherein said light-absorbing material comprises a synthetic polymer or rubber having a light-absorbing substance incorporated therein.

4. A method for forming an image as in claim 1, wherein said light-absorbing material has a roll form.

5. A method for forming an image as in claim 1, wherein said light-absorbing material comprises carbon black.

6. A method for forming an image as in claim 5, wherein said carbon black has an average particle size of from 0.1 to 100 μm.

7. A method for forming an image as in claim 1, wherein said heat-sensitive recording layer comprises an achromatic electron-donating dye precursor and an electron-accepting compound.

8. A method for forming an image as in claim 7, wherein said achromatic electron-donating dye precursor is selected from the group consisting of triarylmethane compounds, diphenylmethane compounds, xanthene compounds, thiazine compounds, and spiropyran compounds.

9. A method for forming an image as in claim 7, wherein said achromatic electron-donating dye precursor is contained in microcapsules.

10. A method for forming an image as in claim 9, wherein said electron-donating dye precursor is present in an amount of 0.05 to 5.0 $g/m^2$ in said recording layer.

* * * * *